US005791409A

United States Patent [19]

Flanders

[11] Patent Number: 5,791,409

[45] Date of Patent: Aug. 11, 1998

[54] HYDRO-MECHANICAL MULTI-STRING CUTTER

[75] Inventor: Bruce Flanders, Houston, Tex.

[73] Assignee: Baker Hughes Incorporated, Houston, Tex.

[21] Appl. No.: 709,317

[22] Filed: Sep. 9, 1996

[51] Int. Cl.[6] ..... E21B 29/00

[52] U.S. Cl. ..... 166/55.8; 166/298

[58] Field of Search ..... 166/55.7, 55.8, 166/298; 175/267, 269, 286, 292

[56] References Cited

U.S. PATENT DOCUMENTS

| | | | |
|---|---|---|---|
| 1,913,636 | 6/1933 | King | 166/55.8 |
| 2,136,518 | 11/1938 | Nixon . | |
| 3,083,765 | 4/1963 | Kammerer | 166/55.8 |
| 3,171,502 | 3/1965 | Kammerer | 175/267 |
| 3,414,069 | 12/1968 | Kammerer | 175/268 |
| 3,684,009 | 8/1972 | Murray | 166/55.8 |
| 3,920,070 | 11/1975 | Goins | 166/55.8 |
| 4,893,675 | 1/1990 | Skipper | 166/55.8 |
| 4,938,291 | 7/1990 | Lynde et al. | 166/55.8 |
| 5,018,580 | 5/1991 | Skipper | 166/298 |
| 5,101,895 | 4/1992 | Gilbert | 166/55.8 |

FOREIGN PATENT DOCUMENTS

| | | |
|---|---|---|
| 194764 | 5/1907 | Germany . |
| 2 124 678 | 2/1984 | United Kingdom . |
| 2 279 383 | 1/1995 | United Kingdom . |

*Primary Examiner*—George A. Suchfield
*Attorney, Agent, or Firm*—Gerald W. Spinks

[57] ABSTRACT

A downhole cutting tool for use in a wellbore, the cutting tool having a mandrel and a cylindrical knife body slidably mounted coaxially on the mandrel. The mandrel can be attached to or suspended from any type of workstring. The upper ends of a plurality of knife blades are pivotably mounted at fixed points on the knife body. The knife blades are suspended therefrom over a plurality of ramps formed on the exterior of the mandrel. A pressure chamber is formed between the knife body and the mandrel. Fluid from the work string can be directed through the mandrel to the pressure chamber, to drive the knife body downwardly relative to the mandrel, causing the lower ends of the knife blades to contact the ramps on the mandrel and kick or pivot outwardly to cause the lower tip of the blade to contact the downhole material to be cut. As the mandrel is rotated, the knife blades rotate with it and cut into the material. The point at which the lower end of the blade contacts the ramp is a fulcrum point which is closer to the lower tip of the blade than to the upper end of the blade. This creates a mechanical advantage causing the lower tip of the blade to be more forcefully urged into the material to be cut.

17 Claims, 3 Drawing Sheets

HYDRO-MECHANICAL MULTI-STRING CUTTER

FIELD OF INVENTION

The present invention is in the field of devices used to cut materials downhole in a well bore. Specifically the present invention includes one embodiment which is used to cut through one or more casing strings in a well bore, to enable removal of the upper part of the casing string from the well bore.

BACKGROUND OF THE INVENTION

When an oil or gas well is drilled, it is common to line the wellbore with a casing, or sometimes two or more casings or liners. After the passage of the drill bit, forming the bore hole, the casing or liner is lowered into the wellbore. If multiple casings are used, one casing is typically suspended coaxially inside the other. Successively smaller strings can be hung in the well bore to provide access to deeper strata of the formation, or to pass through particular strata in some cases. The concentric casings might be cemented in place, or they may not.

When such a well is reworked, it can become necessary to remove some or all of the casings. The casings can be milled away, removing all of the material in the form of small chips suspended in the drilling fluid and carried to the surface. Alternatively, the casing string can be cut through at a downhole location, after which the upper portion of the casing is pulled out of the hole. If multiple strings are unsecured by cement or locking devices, this cutting and removal is usually done in sections. If two or more casings are hanging concentrically in the well, it is very useful to have a cutting tool which will cut through all of the casings. The casings can then be removed separately or together, depending upon the diameter, weight, and equipment available.

Some of the casings used in wells are very thick-walled and heavy, requiring the application of considerable force by the cutting tool to penetrate the casing, and to cut through it all around. Further, lifting heavy casings out of the well with the cutting tool can be difficult if the casing is heavy, since a great gripping force is required to ensure that the casing section is not dropped. Currently known tools suffer from the disadvantage that they are not able to apply sufficient outward force to cause their blades to quickly penetrate the casing, and support of the casing by the cutting tool is often impossible or very unstable.

This difficulty arises chiefly from the geometry commonly found in the cutting knives and their deployment apparatus. The cutting tool must have an initial outside diameter that is small enough to fit inside the casing to be cut. Then, the cutting tool must be able to expand its knives to a sufficient diameter to cut through the casing. Especially if multiple strings are to be cut, the knives might need to expand to reach a significant distance from the original outside diameter of the cutting tool. In order to achieve these goals, it is common to use relatively long knife blades, and to pivot each of the blades about one end to deploy the other end a significant distance from the cutting tool.

Various mechanisms are in use for pivoting the blades outwardly. Typically, they incorporate some sort of piston which is forced between the pivot points of the blades to force them to pivot outwardly. Since the goal is to cause the outer ends of the knife blades to reach outwardly through several casing strings, it is common for the piston or other mechanism to contact each blade relatively near its pivot point. This results in the greatest possible amount of movement of the outer tip of the knife blade, for a given amount of piston movement.

Unfortunately, if the drive mechanism contacts the knife blade near the pivot end of the blade, this means that the force applied by the outer tip of the blade against the casing is significantly reduced. Most often, the drive mechanism contacts the knife blade closer to the pivot point than to the outer tip, resulting in a division of the force applied, rather than multiplication of the force. This reduction of the applied force may be acceptable if the casing is relatively soft, and the knife blade is still able to take a reasonable bite into the casing. In more recent wells, the casing used is likely to be a relatively hard steel, requiring the application of considerable force by the knife blade, if effective cutting is to be achieved. Depending upon the type of cutting elements with which the knife blade is dressed, it can be necessary to apply significantly more force to the cutting edge of the blade than available with previously known systems, in order to form relatively short, thick metal chips. If insufficient force is applied, the metal chips may be long and stringy, and more difficult to remove from the wellbore.

Another problem with some currently known cutting tools is that the upper portion of the casing may be too heavy to be retrieved with the cutting structure of the cutting tool. In such cases, a separate tool may be required to remove the cut casing from the wellbore, or an additional grappling mechanism may be required on the cutting tool itself. Very often, because of the lack of a mechanical advantage in deployment of the blades of currently known tools, the blades do not exert enough outward force to hold the weight of the upper portion of the casing, after it has been cut free from the lower portion.

It is desirable, then, to have a cutting tool which will apply sufficient force at its cutting tip, or along its cutting edge, to cut through a casing at an acceptable rate, and to form short chips which can be easily removed from the wellbore with the drilling fluid. Further, it is desirable to have a cutting tool which is constructed so as to be able to retrieve the cut casing without the use of an additional tool or an additional mechanism on the cutting tool.

SUMMARY OF THE INVENTION

The present invention is a tool which can be used for the cutting of material downhole in a wellbore. The specific embodiment shown is a multi-string casing cutter; however, the same basic tool design could be used for a tool suited for use as an upreamer or a section mill. In any case, the cutting action is first executed in a generally outward direction from the tool body. This outward cutting action can then be followed by pulling of the tool from the well with the knife blades extended, as might be required to pull a section of casing with a casing cutter. Alternatively, the outward cutting can be followed by a continuation of the cutting action in an upward direction, such as might be required of an upreamer or section mill.

The cutting tool includes a longitudinal mandrel, attachable to a workstring, with a fluid flow path from the top end of the mandrel to its bottom end. A cylindrical housing or knife body is assembled concentrically onto the mandrel in a sliding relationship, with an annular space in between. The annular space is divided into two chambers, one above the other, with the division between the chambers being formed by an annular flange which projects outwardly from the mandrel. The lower chamber is a pressure chamber, which is connected in fluid flow communication with the fluid flow path in the mandrel, by a lateral fluid passageway. The fluid flowing through the mandrel can be used to pressurize the pressure chamber between the mandrel and the knife body, to drive the knife body downwardly with respect to the mandrel. The upper chamber is a return spring chamber, housing a return spring which biases the knife body upwardly relative to the mandrel.

At least two, and preferably more, knife blades are suspended from the lower end of the knife body. The knife blades can be dressed with any kind of cutting element desired. Each blade is elongated, and it is suspended from the knife body by means of a pivot pin near the upper end of the knife blade. The pivot pin fixes the pivot point of the knife blade at a fixed radial distance from the axis of the cutting tool, to ensure that the knife blade is maintained in the proper cutting relationship with the material which is to be cut. The lower end of each knife blade is suspended over a cone formed into the lower end of the mandrel. This cone can be divided into sections, with each section forming a ramp directly under the lower end of one of the knife blades. The cone or ramp slopes downwardly and outwardly, so that, as the knife body is forced downwardly by the fluid pressure in the pressure chamber, the lower end of the knife blade contacts the cone or ramp and is kicked outwardly. A vertical abutment is formed on the cone next to each ramp section, to contact the side of each knife blade and keep each blade aligned with its respective ramp.

This outward pivoting of the lower ends of the knife blades brings the outer tip of each blade into cutting contact with the material to be cut, which in the case of the preferred embodiment is a casing string. The contact point where the lower end of the knife blade meets the ramp or cone acts as a fulcrum. The fulcrum, or contact point, moves downwardly along the ramp as the knife body and the knife blade are driven downwardly. The upper portion of the knife blade, between the contact point and the pivot point, acts as a force moment arm, being the arm between the application of the force and the fulcrum. The lower portion of the knife blade, between the contact point and the outer tip of the blade, acts as a resistance moment arm, being the arm between the fulcrum and the resistance offered by the material being cut or supported by the knife blade. The force moment arm is longer than the resistance moment arm, and preferably three or four times longer. This results in a significant mechanical advantage, multiplying the force which can be applied to the material being cut or supported, for a given level of fluid pressure available to the pressure chamber.

The use of the mandrel cone can also offer a significant advantage over currently known tools in the lifting of cut casing out of the wellbore. Since the ramps on the conical face are formed on the mandrel, the weight of the tool and the casing are entirely carried by the mandrel and the workstring. No weight load is carried by the hollow knife body. The cone portion of the mandrel is formed of a substantial cross section of solid steel, for added strength. The hollow knife body need only be strong enough to apply the cutting force to the upper ends of the knife blades, and this force is not excessive, because of the available mechanical advantage discussed above. This causes the tool of the present invention to perform significantly better than any currently known tools which locate the fulcrum on an outer housing, since the mandrel is better able to carry significant weight than a hollow housing would be. If the outer ends of the knife blades are placed under a great weight of cut casing, a tool with the fulcrum on a hollow housing might suffer from inward deformation of the housing.

Further, because of the use of the mandrel cone, the ramps in the tool of the present invention can be relatively long, to facilitate the desired outward movement of the knife blade lower tip, without appreciably lengthening the resistance moment arm. The contact point between blade and ramp moves outwardly along the ramp as the blade is deployed, and the lengths of the force moment arm and the resistance moment arm are relatively constant. In currently known tools which place the fulcrum on an outer housing, the limited thickness of the hollow housing limits the length of the ramps. This means that, to achieve the desired outward displacement of the blade tip, the blades of the currently known tools must be shaped with a long curving contact surface, causing the contact point to slide along the blade toward the upper end of the blade. This sliding of the fulcrum or contact point upwardly along the blade, in currently known tools, simultaneously shortens the force moment arm and lengthens the resistance moment arm, rapidly reducing the mechanical advantage.

The fluid passageway through the mandrel has a flow restriction in its lower end. The flow restriction is sized so as to allow sufficient flow of fluid during normal operations, producing less than a selected level of back pressure. When it is desired to deploy the knife blades, the fluid flow through the workstring is increased, thereby increasing the back pressure caused by the flow restriction. This increased back pressure within the mandrel causes an increase in the fluid pressure in the pressure chamber between the mandrel and the knife body. This increased fluid pressure causes the pressure chamber to expand against the bias of the return spring, driving the knife body downwardly relative to the mandrel.

When the lower ends of the knife blades contact the ramps, or the cone, the outer tips of the blades are kicked outwardly into forceful contact with the casing. The mandrel is rotated, and the abutments contact the sides of the knife blades, causing the knife blades to rotate with the mandrel. This causes the cutting elements on each knife blade to cut into the casing. Once the casing has been penetrated, the knife blade can be driven further outwardly to contact and cut through a second casing string. Alternatively, the rotation can be stopped and the work string can be lifted, to pull the cut section of casing from the hole. When the casing has been cut through, the weight of the upper section of casing rests on the knife blades and wedges them against the cone of the mandrel, preventing inadvertent retraction of the blades. In this condition, the weight of the casing tends to keep the blades in the extended position, while only the force of the return spring tends to raise the knife body and retract the blades. Therefore, as long as the weight of the cut section of casing exceeds the compressive strength of the return spring, the spring can not retract the blades. Since the blades rest on the cone of the mandrel, as discussed above, the tool can support a substantial weight on the knife blades. This allows the cutting tool to be used in lifting the cut section of casing out of the hole, without use of an additional grappling tool.

The novel features of this invention, as well as the invention itself, will be best understood from the attached drawings, taken along with the following description, in which similar reference characters refer to similar parts, and in which:

DESCRIPTION OF PREFERRED EMBODIMENTS

Figure 1:
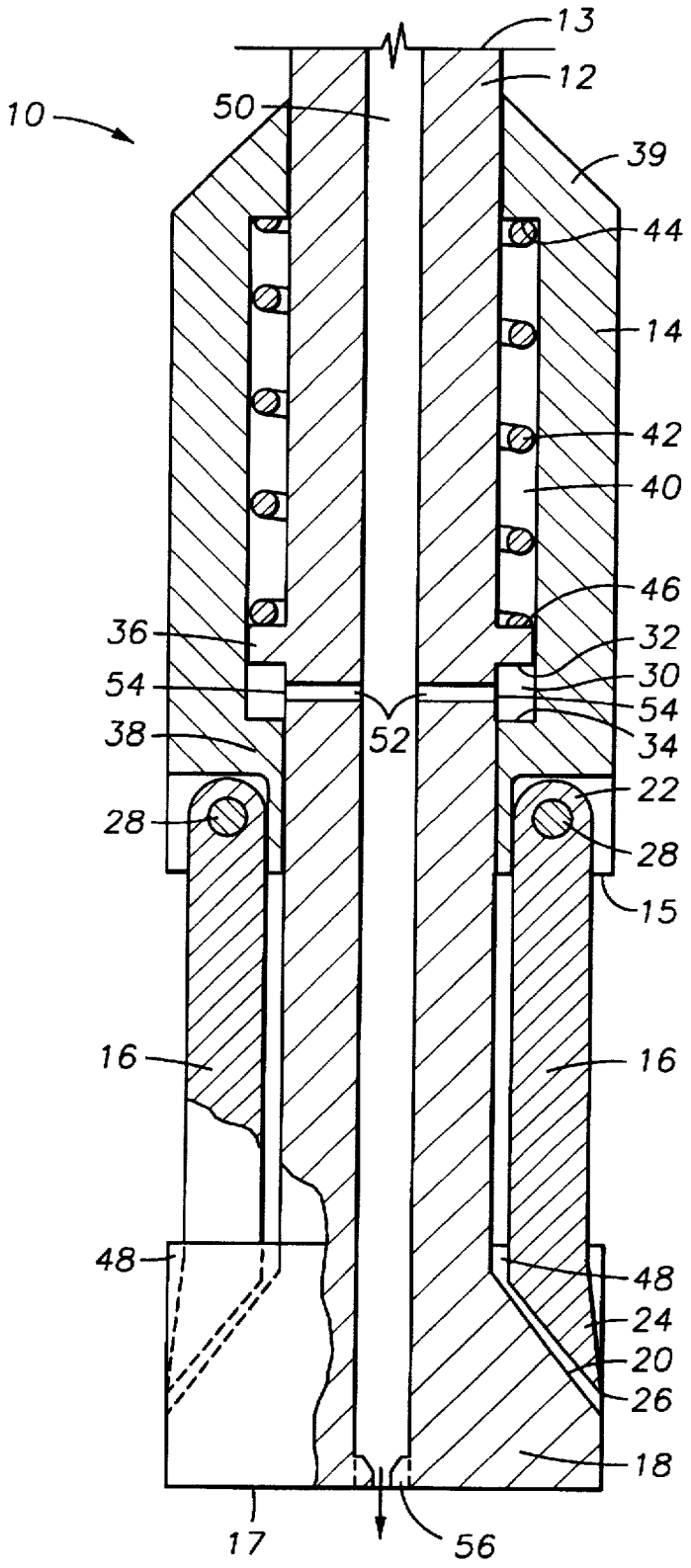
FIG. 1 is a section view of one embodiment of the present invention.

As shown in FIG. 1, the preferred embodiment of the casing cutting tool 10 of the present invention consists of an elongated mandrel 12, a substantially cylindrical knife body 14, a plurality of elongated knife blades 16, and a lower cone 18 on the mandrel 12. The mandrel 12 is attachable at its upper end 13 to a workstring (not shown). The workstring could be a conventional drill string of threaded pipe, or it could be another type of workstring, such as a coiled tubing string supporting a downhole mud motor. The knife blades 16 are pivotably suspended from a point near the lower end 15 of the knife body 14.

Each knife blade 16 is suspended above a ramp 20 formed on the sloping surface of the cone 18. The cone 18 is solid, except for a fluid flow passageway, and the outer diameter of the cone 18 is substantially the same as the maximum outer diameter of the cutting tool 10. The slope of the ramps 20 can be made relatively steeper to achieve greater mechanical advantage, or flatter to achieve a greater movement of the blades 16. Each blade 16 has, generally, an upper end 22 and a lower end 24. An outer tip 26 is formed on the lowermost extremity of each blade 16. The upper end 22 of each blade 16 is attached to the knife body 14 by means of a pivot pin 28. The pivot pin 28 can be formed as a part of the knife blade 16 and pivoted in a fixed hole in the knife body 14. Alternatively, the pivot pin 28 can be fixedly mounted in the knife body 14, and the upper end 22 of the knife blade 16 could have a hole which pivots around the pivot pin 28. In either case, the pivot point of the blade 16 is fixed by the pivot pin 28 with relation to the knife body 14.

The knife body 14 is a hollow substantially cylindrical body concentrically mounted in a sliding relationship on the mandrel 12, with an annular space in between. A lower annular flange 38 and an upper annular flange 39 project inwardly from the inner surface of the knife body 14, to create the annular space. The annular space between the mandrel 12 and the knife body 14 is divided into a pressure chamber 30 and a return spring chamber 40, by an annular flange 36 projecting outwardly from the outer surface of the mandrel 12, between the inwardly projecting flanges 38, 39. The outer wall of the pressure chamber 30 and the return spring chamber 40 is formed by the inner surface of the knife body 14, and the inner wall of the pressure chamber 30 and the return spring chamber 40 is formed by the outer surface of the mandrel 12. The upper wall 32 of the pressure chamber 30 is formed by the lower face of the annular flange 36, and the lower wall 34 of the pressure chamber 30 is formed by the upper face of the lower flange 38 on the knife body 14. The upper wall 44 of the return spring chamber 40 is formed by the lower face of the upper flange 39, and the lower wall 46 of the return spring chamber 40 is formed by the upper face of the annular flange 36 on the mandrel 12. A helical spring 42 under compression is positioned in the return spring chamber 40, surrounding the mandrel 12, pressing against the upper wall 44 and the lower wall 46 of the return spring chamber 40.

A vertically rising abutment 48 is located next to each ramp 20, with a substantially vertical face next to the ramp 20. Each abutment 48 rises past the lower end of its respective knife blade 16, when the cutting tool 10 is fully extended, and the knife blades 16 are at their highest point. Rotation of the mandrel 12 causes each abutment 48 to contact its respective knife blade 16, causing the knife blades 16 to rotate with the mandrel 12.

A fluid flow passageway passes through the mandrel 12 to allow the flow of drilling fluid to the wellbore below the cutting tool 10, and to enable the selective expansion of the knife blades 16. The fluid flow passageway consists of a longitudinal bore 50, which passes through the mandrel 12 from its upper end 13 to its lower end 17, and at least one lateral bore 52, passing from the longitudinal bore 50 to the exterior surface of the mandrel 12. A port 54 is located in the outer end of the lateral bore 52, where the fluid flow passageway enters the fluid pressure chamber 30. A flow restriction 56 is built into the fluid flow passageway in the lower end of the longitudinal bore 50. The flow restriction 56 is sufficiently large to allow a normal flow rate of drilling fluid to traverse the cutting tool 10 without creating an appreciable back pressure.

However, the flow restriction 56 is sufficiently small so that the fluid flow rate can be increased with pumps at the well site, to create a back pressure in the fluid flow passageway. Specifically, a back pressure is created in the vicinity of the lateral bore 52, to cause an increase in fluid pressure within the pressure chamber 30. This pressure acts against the upper wall 32 and the lower wall 34 of the pressure chamber 30, to cause the pressure chamber 30 to expand. At the same time, the return spring 42 is acting against the upper wall 44 and the lower wall 46 of the return spring chamber 40 to resist expansion of the pressure chamber 30. When desired, a sufficiently large back pressure can be created to overcome the compression strength of the return spring 42 and to drive the knife body 14 downwardly relative to the mandrel 12.

Figure 2:
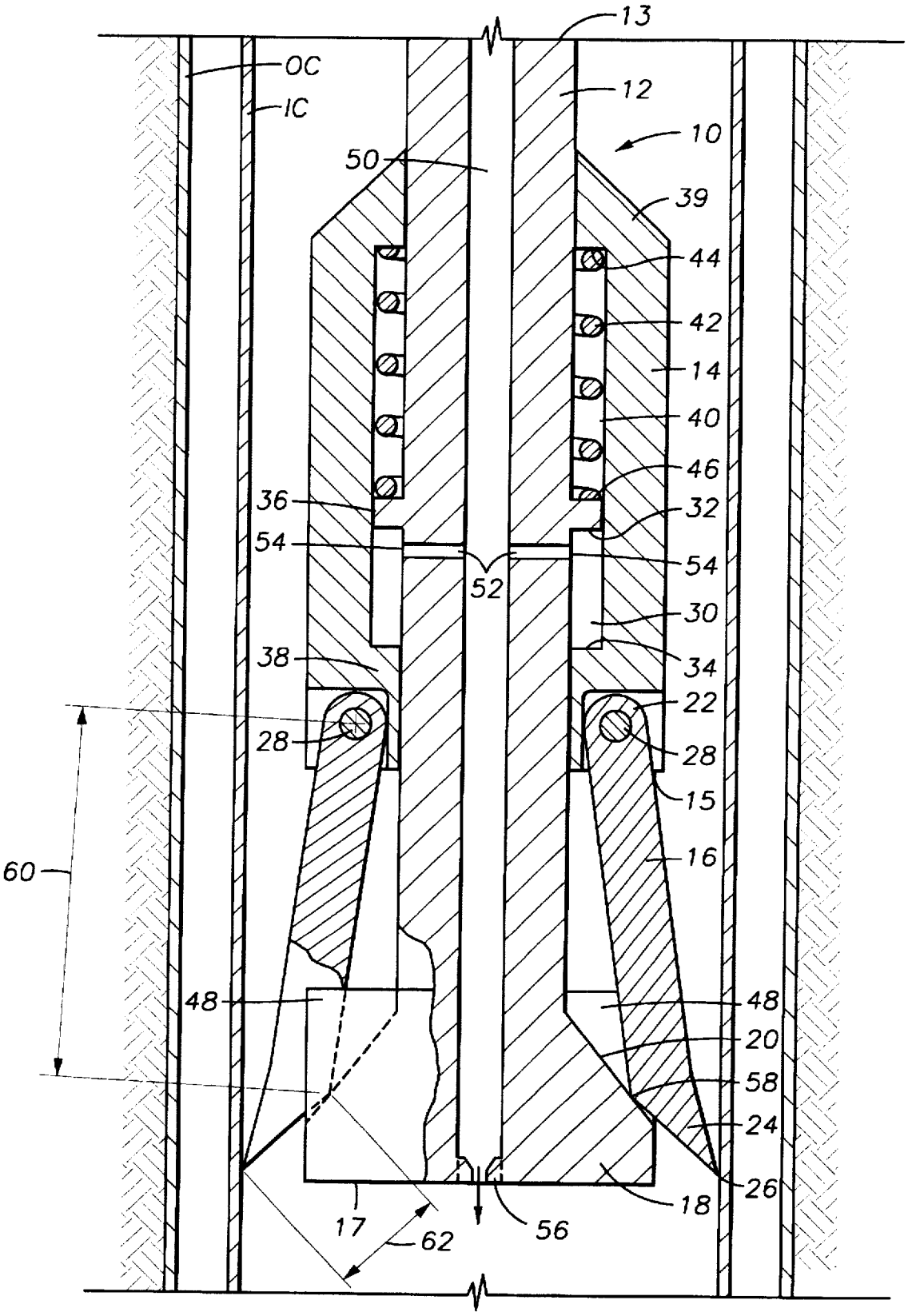
FIG. 2 is a section view of the embodiment shown in FIG. 1, with the knife blades partially deployed to contact a first casing string.

FIG. 2 shows the cutting tool 10 positioned in a wellbore, within an inner casing IC and an outer casing OC. In this view, the fluid flow rate through the longitudinal bore 50 has been increased to the point that the flow restriction 56 has caused a back pressure within the fluid flow passageway. The back pressure is sufficient to raise the pressure within the pressure chamber 30 to the point where the compression strength of the return spring 42 has been overcome, and the pressure chamber 30 has begun to expand. Expansion of the pressure chamber 30 has caused the knife body 14 to be driven downwardly a short distance relative to the mandrel 12. This relative movement has caused the lower ends 24 of the knife blades 16 to contact the ramps 20, causing the lower ends 24 of the knife blades 16 to kick outwardly. The lower tips 26 of the knife blades 16 have moved outwardly sufficiently to contact the inner surface of the inner casing IC.

It can be seen that, in the deployment shown in FIG. 2, the knife blade 16 contacts the ramp 20 at a contact point 58. The contact point 58 acts as a fulcrum, and the upper portion of the blade 16 acts as a force moment arm 60, while the lower portion of the blade 16 acts as a resistance moment arm 62. The force moment arm 60 is longer than the resistance moment arm 62, and preferably three or four times as long, yielding a significant mechanical advantage in applying cutting force to the casing. The workstring is then rotated, causing the mandrel 12 and the knife blades 16 to rotate. The lower tip 26 of the blade 16 then begins to cut into the inner casing IC. As the lower tip 26 of the blade 16 advances through the casing, the resistance moment arm 62 will shorten, as the contact area between the blade 16 and the casing advances upwardly along the edge of the blade 16. The length of the force moment arm 60 remains relatively constant.

The knife blade 16 in this embodiment has a corner of the blade 16 forming the contact point 58, so the location of the contact point 58 is stationary relative to the blade 16, as the contact point 58 progresses down the ramp 20. Alternatively, the blade 16 could have a rounded contour at the contact point 58. Even with a rounded contour at the contact point 58, the location of the contact point 58 relative to the blade 16 changes only slightly as it progresses down the ramp 20. Either configuration ensures that the length relationship between the force moment arm 60 and the resistance moment arm 62 remains substantially the same.

At the stage of deployment shown in FIG. 2, the cutting tool 10 also can be used to pull the upper section of the inner casing IC from the wellbore. The contact point 58 of the knife blade 16 is positioned on the ramp 20, and the weight of the upper section of the inner casing IC wedges the knife blade 16 against the cone 18. The heavier the casing, the more securely the knife blade 16 is wedged against the cone 18. The workstring can now be lifted, pulling the mandrel 12 out of the wellbore. As the mandrel 12 rises, the knife blades 16 are pulled upwardly, since they are tightly wedged against the cone 18. Since the knife blades 16 are wedged in a position where they extend outwardly past the inner casing IC, the blades 16 lift the cut upper section of the inner casing IC out of the wellbore.

In this stage of deployment, the compressive force of the return spring 42 tends to cause the knife blades 16 to retract. However, in order to actually retract the knife blades 16, the return spring 42 would have to be strong enough to lift the knife body 14 and the cut section of casing sufficiently to relieve the force wedging the knife blades 16 against the cone 18. Typically, the weight of the cut section of casing will be far in excess of the compressive force generated by the return spring 42, and the knife blades 16 will remain wedged against the mandrel cone 18.

Figure 3:
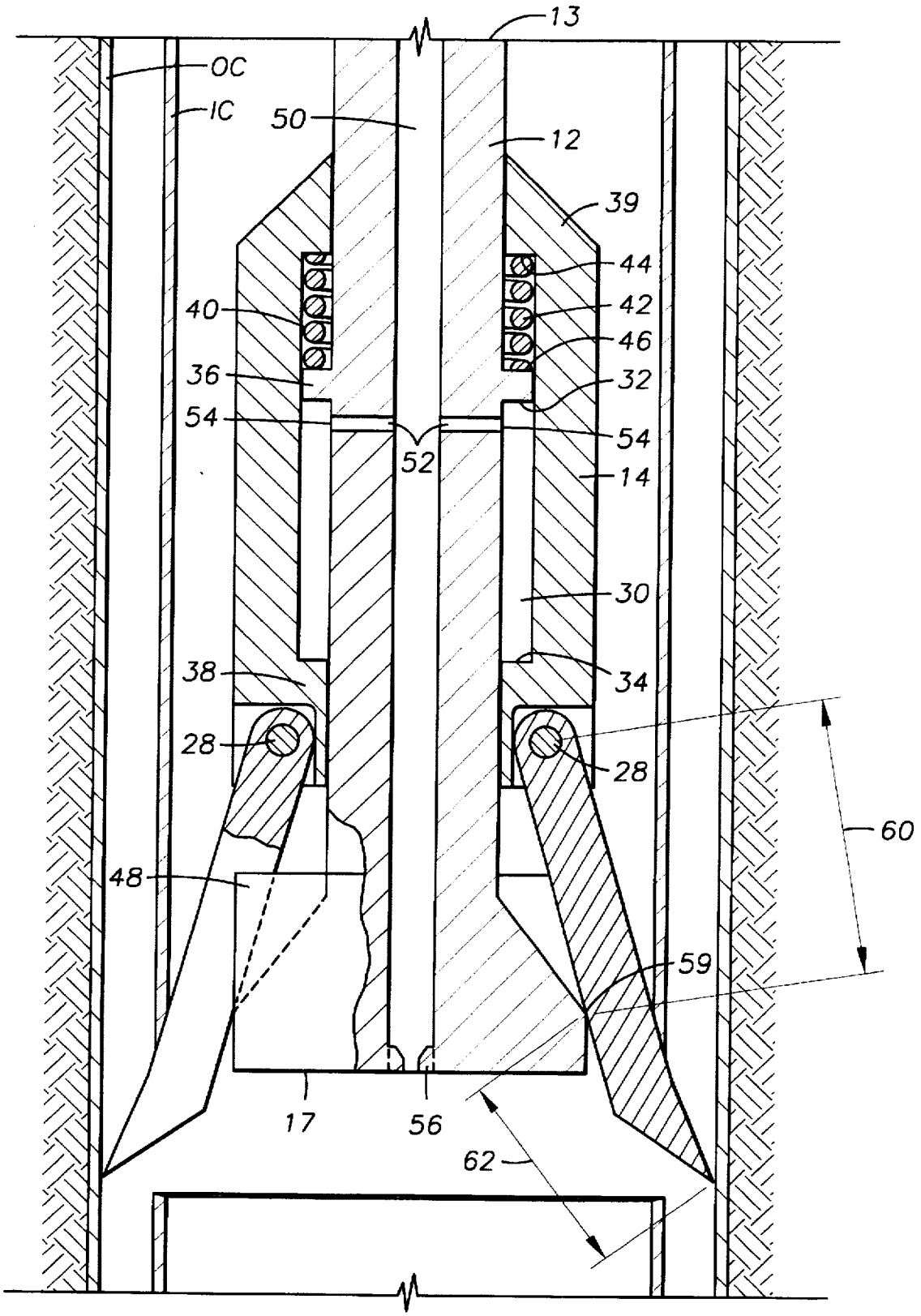
FIG. 3 is a section view of the embodiment shown in FIG. 1, with the knife blades further deployed to contact a second casing string.

FIG. 3 shows the cutting tool 10 in a more advanced stage of deployment of the knife blades 16. Further expansion of the pressure chamber 30 has caused the knife body 14 to be driven downwardly an additional distance relative to the mandrel 12. This additional relative movement has caused the lower ends 24 of the knife blades 16 to kick outwardly, off of the outer edge of the cone 18. The lower tips 26 of the knife blades 16 have moved outwardly sufficiently to contact the inner surface of the outer casing OC. It is to be expected that the lower tips 26 of the blades 16 will have worn down significantly by this point.

It can be seen that, in the deployment shown in FIG. 3, the knife blade 16 contacts the ramp 20 at a contact point 59. The contact point 59 acts as a fulcrum, and the upper portion of the blade 16 acts as a force moment arm 60, while the lower portion of the blade 16 below the edge of the cone 18 acts as a resistance moment arm 62. The force moment arm 60 is still significantly longer than the resistance moment arm 62, still yielding a significant mechanical advantage in applying cutting force to the inner casing IC and the outer casing OC. As the lower tip 26 of the blade 16 advances through the outer casing OC, the force moment arm 60 will shorten slightly, as the knife blade 16 slides down past the contact point 59 at the edge of the cone. However, the length of the resistance moment arm 62 also will shorten slightly, as the contact area between the knife blade 16 and the outer casing OC moves up the edge of the blade 16.

Rather than cutting into an outer casing OC, the cutting tool 10 can be used in this configuration to pull the upper section of the inner casing IC from the wellbore. The original contact point of the knife blade 16 has kicked off of the edge of the ramp, causing the weight of the upper section of the inner casing IC to wedge the knife blade 16 even more forcefully against the cone 18 than in FIG. 2. Here again, the heavier the casing, the more securely the knife blade 16 is wedged against the cone 18. The workstring can be lifted, pulling the mandrel 12 out of the wellbore. As the mandrel 12 rises, the knife blades 16 are pulled upwardly, since they are tightly wedged against the cone 18. Since the knife blades 16 are wedged in a position where they extend outwardly past the inner casing IC, the blades 16 lift the cut upper section of the inner casing IC out of the wellbore.

In this stage of deployment, the only force tending to cause the knife blades 16 to retract is the compressive force of the return spring 42. The weight of the casing can not urge the blade 16 to ride up over the contact point 59, or to slide up the ramp 20. In order to actually retract the knife blades 16, the return spring 42 would have to be strong enough to lift the knife body 14 and the cut section of casing sufficiently to relieve the force wedging the knife blades 16 against the cone 18. Typically, the weight of the cut section of casing will be far in excess of the compressive force generated by the return spring 42, and the knife blades 16 will remain wedged against the mandrel cone 18.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

I claim:

1. A cutting tool for cutting materials in a wellbore, comprising:

a mandrel attachable to a workstring, for suspension in a wellbore, said mandrel being rotatable about its longitudinal axis;

a plurality of downwardly and outwardly sloping ramps formed on said mandrel;

a knife body slidably mounted on said mandrel;

a hydraulic pressure chamber formed between said mandrel and said knife body, such that hydraulic pressure applied to said pressure chamber forces said knife body to slide downwardly relative to said mandrel;

a fluid flow passageway formed through said mandrel to said pressure chamber, such that fluid flow from the workstring can be directed to said pressure chamber; and a plurality of knife blades, each having an upper end pivotably affixed to said knife body, each said blade being vertically aligned above one of said ramps, said ramp contacting a fulcrum point near a lower end of said blade to cause a lower tip of said blade to pivot outwardly into contact with the material to be cut, as said knife body is forced downwardly;

wherein a first moment arm between said upper end of said blade and said fulcrum point is longer than a second moment arm between said fulcrum point and said lower tip.

2. A cutting tool as recited in claim 1, further comprising a plurality of abutments formed on said mandrel, each said abutment being located adjacent to one of said ramps, each said abutment being constructed to abut one of said blades and force said blade to rotate as said mandrel rotates.

3. A cutting tool as recited in claim 1, further comprising a return spring, said return spring being mounted so as to bias said knife body upwardly relative to said mandrel.

4. A cutting tool as recited in claim 1, further comprising a flow restriction in said fluid flow passageway, said flow restriction being sized to create a backpressure within said fluid flow passageway to pressurize said pressure chamber.

5. A cutting tool for cutting materials in a wellbore, comprising:

an elongated mandrel, said mandrel being attachable at its upper end to a workstring, for suspension in a wellbore, said mandrel being rotatable about its longitudinal axis;

a plurality of downwardly and outwardly sloping ramps formed on said mandrel;

a hollow, generally cylindrical knife body slidably mounted on said mandrel above said plurality of ramps;

a hydraulic pressure chamber formed between said mandrel and said knife body, said pressure chamber having a lower face formed on said knife body and an upper face formed on said mandrel, such that hydraulic pressure applied to said pressure chamber forces said knife body to slide downwardly on said mandrel;

a fluid flow passageway formed through said mandrel from said upper end of said mandrel to an outer surface of said mandrel within said pressure chamber, such that fluid flow from the workstring is directed to said pressure chamber; and a plurality of knife blades pivotably mounted to said knife body, each of said blades being vertically aligned above one of said ramps, said ramp contacting a lower end of said blade to cause said lower end of said blade to pivot outwardly as said knife body is forced downwardly.

6. A cutting tool as recited in claim 5, further comprising a plurality of abutments formed on said mandrel, each said abutment being located adjacent to one of said ramps, each said abutment being constructed to abut one of said blades and force said blade to rotate as said mandrel rotates.

7. A cutting tool as recited in claim 5, further comprising a return spring, said return spring being mounted so as to bias said knife body upwardly relative to said mandrel.

8. A cutting tool as recited in claim 5, where in said fluid flow passageway comprises:

a longitudinal bore through said mandrel from said upper end to a lower end of said mandrel; and a lateral bore from said longitudinal bore to a port in said outer surface of said mandrel, said port being located within said pressure chamber.

9. A cutting tool as recited in claim 8, further comprising a flow restriction in said longitudinal bore below said lateral bore, said flow restriction being sized to create a backpressure within said longitudinal bore to pressurize said pressure chamber via said lateral bore.

10. A cutting tool as recited in claim 5, wherein:

said knife body surrounds said mandrel to form said pressure chamber as an annular space between said mandrel and said knife body;

said upper face of said pressure chamber comprises an annular exterior flange formed on said mandrel; and said lower face of said pressure chamber comprises a lower annular interior flange formed within said knife body.

11. A cutting tool as recited in claim 10, further comprising:

a return spring chamber between said mandrel and said knife body; and an upper annular interior flange within said knife body forming an upper face of said return spring chamber;

wherein said annular exterior flange on said mandrel forms a lower face of said return spring chamber, said return spring being compressed between said upper face and said lower face of said return spring chamber.

12. A cutting tool as recited in claim 5, further comprising a plurality of pivot pins fixedly mounted in a lower end of said knife body, each said knife blade pivoting about one of said pivot pins.

13. A cutting tool as recited in claim 5, wherein:

said lower end of each said blade contacts said ramp at a fulcrum point;

said lower end of each said blade contacts the material to be cut at a resistance point;

a first moment arm exists between said fulcrum point and a point of attachment of said blade to said knife body;

a second moment arm exists between said fulcrum point and said resistance point; and said first moment arm is longer than said second moment arm.

14. A cutting tool for cutting materials in a wellbore, comprising:

an elongated mandrel, said mandrel being attachable at its upper end to a workstring, for suspension in a wellbore, said mandrel being rotatable about its longitudinal axis;

a plurality of downwardly and outwardly sloping ramps formed on said mandrel;

a hollow, generally cylindrical knife body slidably mounted coaxially around said mandrel;

an annular hydraulic pressure chamber formed between said mandrel and said knife body;

an annular exterior flange formed on said mandrel to form an upper face of said pressure chamber;

a lower annular interior flange formed within said knife body to form a lower face of said pressure chamber;

a longitudinal fluid flow passageway through said mandrel from said upper end to a lower end of said mandrel;

a lateral passageway from said longitudinal passageway to a port in said outer surface of said mandrel, said port being located within said pressure chamber, such that fluid flow from the workstring can be directed to said pressure chamber to drive said knife body downwardly relative to said mandrel;

a plurality of knife blades pivotably mounted to pivot pins mounted in a lower end of said knife body, each of said blades being vertically aligned above one of said ramps, said ramp contacting a lower end of said blade at a fulcrum point to cause a lower tip of said blade to pivot outwardly to contact the material to be cut, as said knife body is forced downwardly, with a first moment arm between said pivot pin and said fulcrum point being longer than a second moment arm between said fulcrum point and said lower tip.

15. A cutting tool as recited in claim 14, further comprising a plurality of abutments formed on said mandrel, each said abutment being located adjacent to one of said ramps, each said abutment being constructed to abut one of said blades and force said blade to rotate as said mandrel rotates.

16. A cutting tool as recited in claim 14, further comprising a flow restriction in said longitudinal passageway below said lateral passageway, said flow restriction being sized to create a backpressure within said longitudinal passageway, upon an increase in fluid flow rate, to pressurize said pressure chamber via said lateral passageway.

17. A cutting tool as recited in claim 14, further comprising:

a return spring chamber between said mandrel and said knife body;

an upper annular interior flange within said knife body forming an upper face of said return spring chamber, said annular exterior flange on said mandrel forming a lower face of said return spring chamber; and a return spring compressed between said upper face and said lower face of said return spring chamber, to bias said knife body upwardly relative to said mandrel.

* * * * *